United States Patent [19]

Mastrodicasa

[11] Patent Number: 4,938,442

[45] Date of Patent: Jul. 3, 1990

[54] BRACKET AND SHELF ASSEMBLY

[76] Inventor: Arthur R. Mastrodicasa, 36 Donnelly Dr., Dover, Mass. 02030

[21] Appl. No.: 209,312

[22] Filed: Jun. 21, 1988

[51] Int. Cl.[5] ..... A47B 47/00

[52] U.S. Cl. ..... 248/250; 108/6; 108/144; 211/135; 211/187; 248/222.4; 248/242; 248/243; 403/407.1

[58] Field of Search ..... 248/250, 243, 242, 222.4, 248/223.1, 223.2; 211/135, 187, 191, 192; 108/144, 6; 403/407.1, 406.1, 405.1

[56] References Cited

U.S. PATENT DOCUMENTS

| | | | |
|---|---|---|---|
| 605,510 | 6/1898 | Patchett | 463/406.1 |
| 747,683 | 12/1903 | Clark | 403/407.1 |
| 2,088,320 | 7/1937 | DeVries | 189/36 |
| 2,733,037 | 1/1956 | Dunham | 248/222.4 X |
| 2,739,777 | 3/1956 | Schoenhardt | 248/243 |
| 2,890,012 | 6/1959 | Deitch | 248/242 |
| 3,097,822 | 7/1963 | Attwood | 248/250 |
| 3,200,775 | 8/1965 | Peters | 108/108 |
| 3,207,100 | 9/1965 | Peacock | 248/250 X |
| 3,294,250 | 12/1966 | Evans | 108/144 X |
| 3,332,655 | 7/1967 | Van Buren Jr. | 248/223.1 X |
| 3,367,291 | 2/1968 | Evans | 108/64 |
| 3,511,193 | 5/1970 | Schild | 248/243 X |
| 4,103,855 | 8/1978 | Grosse | 248/246 |
| 4,106,630 | 8/1978 | Rosenband | 211/191 |
| 4,199,907 | 4/1980 | Bains et al. | 403/231 X |

FOREIGN PATENT DOCUMENTS

| | | | |
|---|---|---|---|
| 221202 | 10/1957 | Australia | 248/222.4 |
| 293558 | 8/1969 | Australia | 248/242 |
| 113437 | 9/1968 | Norway | 248/250 |
| 880471 | 10/1961 | United Kingdom | 248/250 |
| 932376 | 7/1963 | United Kingdom | 248/250 |

*Primary Examiner*—David L. Talbott

[57] ABSTRACT

A bracket and shelf assembly in which a first component comprising a bracket member or a shelf member, is provided with button means, and the other of the bracket member or shelf member comprises a second component having hole means therein, the hole means being adapted to receive the button means to connect the two components together, the button and hole means being so shaped as to facilitate locking of the two components together by sliding one component relative to the other.

9 Claims, 2 Drawing Sheets

BRACKET AND SHELF ASSEMBLY

BACKGROUND OF THE INVENTION

1. Field of the Invention

This invention relates to a bracket and shelf assembly and is directed more particularly to such an assembly of the "knock-down" type, that is, one that may be readily assembled, disassembled, and reassembled.

2. Description of the Prior Art

It is known in the art to provide bracket members which may be connected to vertical posts or the like, and to which are attached shelf members.

In many instances, the bracket members are provided with hook portions adapted to engage portions of a shelf member to secure the shelf member to the bracket member. In some instances, the bracket member may be provided with one or more moveable components adapted to lock the shelf member in place. Examples of such assemblies are shown and described in U.S. Pat. Nos. 4,658,968 issued Apr. 21, 1987; 4,658,969 issued Apr. 21, 1987; and 4,669,692 issued June 2, 1987, all in the name of Arthur R. Mastrodicasa. The above prior art assemblies are particularly well adapted for the mounting of wire shelves which are readily engaged by the bracket hook portions In the case of solid shelving, it is known to provide shelf members having holes on the underside thereof adapted to receive pins upstanding from bracket members An example of such an arrangement may be seen in U.S. Pat. No. 2,890,012, issued June 9, 1959, in the name of Jacob Deitch.

An object of the present invention is to provide a bracket and shelf assembly in which the bracket and shelf members are provided with button and hole means by which the bracket and shelf members may be connected together.

A further object of the invention is to provide such an assembly in which the button means comprises a shaped button disposed on one component of the assembly and so configured, in conjunction with the other component, to enable the two components to be locked together by a sliding action.

With the above and other objects in view, as will hereinafter appear, a feature of the present invention is the provision of a bracket and shelf assembly comprising first and second bracket members, and a shelf member, each of the bracket members being adapted for attachment to a vertical member and to extend transversely of the vertical member, the first and second bracket members or the shelf member comprising a first component provided with button means extending therefrom, the other component of the first and second bracket members or the shelf member being provided with opening means therein, the opening means being adapted to receive the button means to join the bracket members to the shelf member, the opening means being elongated to permit relative sliding movement between the shelf member and the bracket members, the button means comprising a button having a frusto-conically shaped portion extending from a cylindrically shaped shoulder portion, the smaller diameter portion of the frusto-conically shaped portion being joined to the shoulder portion, the extent of the shoulder portion beyond the first component being less than the thickness of a planar portion of the other component having the opening means therein, the opening means comprising an elongated slot having a first portion of a substantially circular configuration and of a diameter exceeding the large diameter of the button member and a second portion elongated and having a width less than the diameter of the larger diameter of the button and greater than the diameter of the shoulder portion of the button, such that edges of the opening of the slot second portion are wedged between the first component and the walls of the frusto-conical portion of the button as the other component is slid along the button means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings:

FIG. 2 is a side elevational view thereof;

FIG. 3 is a sectional view taken along line III—III of FIG. 2; and

FIG. 4 is an enlarged side elevational view of a button portion of the invention.

DESCRIPTION OF THE PREFERRED EMBODIMENTS

Figure 1:
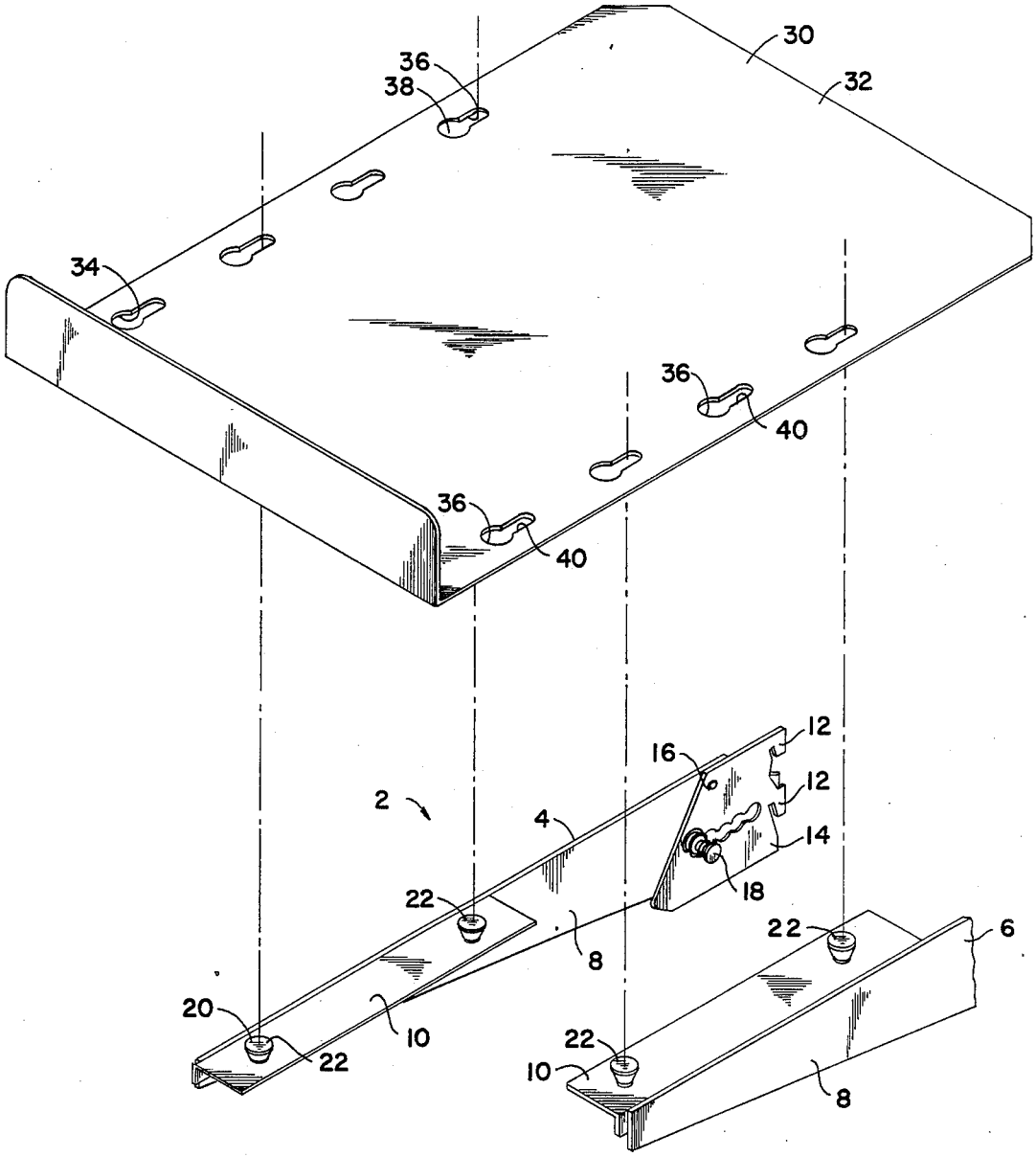
FIG. 1 is an exploded perspective view of one form of bracket and shelf assembly illustrative of an embodiment of the invention.

Referring to the drawings, it will be seen that an illustrative bracket and shelf assembly includes bracket means 2 comprising first and second bracket members 4, 6 comprising elongated support portions having base portions 8 and flange portions 10 extending substantially normal to the base portions. The bracket members 4, 6 are provided with attachment means 12 which facilitate attachment of the bracket members to vertical posts (not shown) in a manner known in the art.

The attachment means 12 may be formed on the base portion 8 or may, as illustrated, be formed on a swivel plate 14 which is pivotally attached to the base portion 8 by a pin 16 and permits angular adjustment of the bracket member in a manner known in the art. A spring-biased set pin 18 is provided to lock the base portion 8 at a selected position.

Non-removeably attached to the flange portions 10 and upstanding therefrom are button means 20 comprising button members 22. Each button member 22 is provided with a cylindrically-shaped shoulder portion 24 (FIG. 4) which is adjacent the bracket flange portion 10. Extending from the cylindrically-shaped shoulder portion 24 is a frusto-conically shaped portion 26. At the free end of the frusto-conically shaped portion 26 is a cylindrically-shaped cap portion 28.

The heighth of the shoulder portion should be less than the thickness of the shelf, to be described hereinbelow. In practice, it has been found that a shoulder portion having a diameter d of 0.290 inch and a heighth h of 0.040 inch has performed well.

It has been found that an angle a at which the walls of the frusto-conically shaped portion extend from a base line b defined by the shoulder portion is critical. An angle a of 52° has been found to provide reasonably easy sliding between the bracket and shelf member, to be further described hereinbelow, and at the same time a safe and secure locking engagement. It is believed that an angle a in the range of 47° to 57° would be appropriate. The frusto-conically shaped portion 26 may be about 0.080 inch in heighth H above the shoulder portion 24. The cap portion 28 may have a diameter D of about 0.410 inch and a heighth h' of about 0.030 inch. The diameter D (0.410 inch) of the cap portion 28 is also the large diameter of the frusto-conically shaped portion 26, and the diameter d of the shoulder portion 24 is also the small diameter of the frusto-conically shaped portion 26.

The bracket members are preferably entirely of metal, but may be formed of a rigid plastic material.

The assembly further includes a shelf means 30 comprising a shelf member 32, preferably constructed of sheet metal or rigid plastic. The shelf member 32 is provided with opening means 34 comprising elongated slots 36. Each of the slots 36 includes a first portion 38 of a substantially circular configuration and of a diameter exceeding the diameter D of said button member cap portion 28 and a second portion 40 elongated and having a width less than the diameter D of the cap portion 28 and greater than the diameter d of the shoulder portion 24 of the button member 22.

In operation, the bracket members 4, 6 are attached to vertical support members (not shown) and, if desired, the angularity of the brackets set by use of the set pin 18 and swivel plate 14. The shelf member 32 is then placed on the flange portions 10 of the bracket members 4, 6 such that the cap portions 28 of the button members 22 enter the first portions 38 of the slots 36. The shelf member is then pulled to the left, as viewed in FIGS. 1 and 2, such that the second portions 40 of the slots 36 slide by the button members 22 and, more specifically, the edges of the slot second portions 40 engage the walls of the frusto-conically shaped portion 26 of the button members 22 (FIG. 3).

The shelf 32 is of a thickness exceeding the heighth h of the shoulder portion 24 of the button members 22. Accordingly, the slot edges impinge upon the walls of the button portion 26 and are forced thereby into tighter engagement with the flange portions 10 of the bracket members, as illustrated in FIG. 3. Thus, the shelf member is wedged into a secure frictional engagement with bracket means 2.

It is to be understood that the present invention is by no means limited to the particular construction herein disclosed and/or shown in the drawings, but also comprises any modifications or equivalents within the scope of the disclosure. For example, while the invention has been illustrated with the button means on the bracket members and the openings in the shelf member, it will be apparent that the assembly could employ openings in the bracket means and downwardly extending button means on the underside of the shelf member. In instances in which a smooth shelf surface is required, without buttons protruding into the storage area, such reversal of the connecting elements is preferred. Thus, a first of either of the basic components, that is, either the shelf or the bracket means, may be provided with the button means and the other of the shelf or the bracket means may comprise a second component having the complemental opening means.

Having thus described my invention, what I claim as new and desire to secure by Letters Patent of the U.S. is:

1. A bracket and shelf assembly comprising first and second bracket members, and a shelf member, each of said bracket members being adapted for attachment to a vertical member and to extend transversely of said vertical member, said first and second bracket members or said shelf member comprising a first component provided with button means extending therefrom, the other component of said first and second bracket members or said shelf member being provided with opening means therein, said opening means being adapted to receive said button means to join said bracket means to said shelf member, said opening means being elongated to permit relative sliding movement between said shelf member and said bracket members, said button means comprising a button having a frusto-conically shaped portion extending from a cylindrically shaped shoulder portion, a smaller diameter portion of said frusto-conically shaped portion being joined to said shoulder portion, the extent of said shoulder portion beyond said first component being substantially less than the thickness of a planar portion of said other component having said opening means therein, said opening means comprising an elongated slot having a first portion of a substantially circular configuration and a diameter exceeding a larger diameter of said button member and a second portion having two straight parallel elongated edges and having a width constant along the length of said two edges and less than the diameter of said larger diameter of said button and greater than the diameter of said shoulder portion of said button, such that said edges of said opening second portion impinge upon said walls of said frusto-conical portion of said button and are wedged between said first component and the walls of said frusto-conical portion of said button as said other component is slid along said button means, said wedging action being operative to lock said first and second components together without additional locking means.

2. The bracket and shelf assembly in accordance with claim 1, in which an angle at which the walls of said frusto-conically shaped portion extend relative to a base line formed by said button shoulder portion is 47°–57°.

3. The bracket and shelf assembly in accordance with claim 1, in which said button means extending from said first component is non-removably attached to said first component.

4. A bracket and shelf assembly comprising first and second brackets, and a shelf member, each of said bracket members being adapted for attachment to a vertical member and adapted to extend transversely of said vertical member, button means upstanding from said bracket members, said shelf member having opening means therein, a first of said opening means being adapted to receive a first of said button means, and a second of said opening means being adapted to receive a second of said button means, said opening means being elongated to permit sliding movement of said shelf member about said button means, said button means comprising a button having a frusto-conically shaped portion extending from a cylindrically-shaped shoulder portion fixed to said bracket member, a small diameter portion of said frusto-conically shaped portion being joined to said shoulder portion, the extent of said shoulder portion beyond said bracket member being substantially less than the thickness of a planar portion of said shelf member defining said opening means, said opening means comprising an elongated slot having a first portion of a substantially circular configuration and of a diameter exceeding a large diameter of said button member and a second portion having two straight parallel elongated edges and having a width constant along the length of said two edges and less than said large diameter of said button and greater than a diameter of said shoulder portion of said button, such that said edges of said opening second portion impinge upon said walls of said frusto-conical portion of said button and are wedged between said bracket member and walls of said frusto-conical portion of said button as said shelf member is slid along said button means, said wedging action being operative to lock said first and second components together without additional locking means.

5. The bracket and shelf assembly in accordance with claim 4, in which each of said bracket members is provided with an elongated planar flange portion extending substantially normal to a base portion, with only said button means upstanding from said planar flange portion.

6. The bracket and shelf assembly in accordance with claim 5, in which a plurality of said buttons are mounted on each of said flange portions.

7. The bracket and shelf assembly in accordance with claim 6 in which said opening means in said shelf member comprise first and second rows of said slots, the portion of said shelf member adapted to engage said planar flange portions of said bracket members being planar and devoid of protrusions.

8. The bracket and shelf assembly in accordance with claim 6 in which said buttons are non-removeably attached to said flange portions.

9. The bracket and shelf assembly in accordance with claim 4, in which the angle at which said walls of said frusto-conically shaped portion extend relative to a base line formed by said button shoulder portion is 47°–57°.

* * * * *